United States Patent [19]

Ioshpa et al.

[11] Patent Number: 4,572,269

[45] Date of Patent: Feb. 25, 1986

[54] METHOD OF MANUFACTURING COOLING PLATES FOR USE IN METALLURGICAL FURNACES AND A COOLING PLATE

[75] Inventors: Vladimir G. Ioshpa, Kharkov; Boris A. Kirievsky, Kiev; Anatoly P. Kravchenko, Zhdanov; Gennady A. Kudinov, Kharkov; Dorina B. Kutsykovich, Kharkov; Evgeny E. Lysenko, Kharkov; Anatoly A. Shokul, Zhdanov; Ignaty N. Nekrasov, Debaltsevo; Oleg V. Filipiev, Kharkov; Vladimir P. Lugansky, Kiev, all of U.S.S.R.

[73] Assignee: Vsesojuzny Nauchno-Issledova-Telsky I Proektny Institut Po Ochistke Tekhnolo, U.S.S.R.

[21] Appl. No.: 537,411

[22] PCT Filed: Feb. 2, 1982

[86] PCT No.: PCT/SU82/00003

§ 371 Date: Sep. 16, 1983

§ 102(e) Date: Sep. 16, 1983

[87] PCT Pub. No.: WO83/02578

PCT Pub. Date: Aug. 4, 1983

[51] Int. Cl.[4] ..... B22D 19/04

[52] U.S. Cl. ..... 164/93; 164/94; 164/95

[58] Field of Search ..... 164/93–95, 164/98–100

[56] References Cited

U.S. PATENT DOCUMENTS

| | | | |
|---|---|---|---|
| 3,461,944 | 8/1969 | Kuebrich | 164/97 |
| 3,706,343 | 12/1972 | Saiga et al. | 266/193 |
| 3,853,309 | 12/1974 | Widmer | 164/98 |
| 4,344,477 | 8/1982 | Miki et al. | 164/98 |

FOREIGN PATENT DOCUMENTS

| | | | |
|---|---|---|---|
| 2263643 | 7/1974 | Fed. Rep. of Germany | 164/93 |
| 2804544 | 8/1979 | Fed. Rep. of Germany | 164/100 |
| 55-45556 | 3/1980 | Japan | 164/93 |

*Primary Examiner*—Nicholas P. Godici
*Assistant Examiner*—Richard K. Seidel
*Attorney, Agent, or Firm*—Steinberg & Raskin

[57] ABSTRACT

A cooling plate made up of three sections with expansion gaskets set at the boundaries thereof is produced by separate casting of molten metal into a foundry mold. Prior to pouring molten metal into the mold, partitions with the expansion gaskets are set in the mold to form molding cavities required to produce three sections, namely: an intermediate section and sections with protruded portions of the cooling pipes. The intermediate section may be likewise divided into several portions.

6 Claims, 10 Drawing Figures

METHOD OF MANUFACTURING COOLING PLATES FOR USE IN METALLURGICAL FURNACES AND A COOLING PLATE

BACKGROUND OF THE INVENTION

The present invention relates to cooling equipment for use in metallurgical furnaces and more in particular to a method of manufacturing cooling plates intended for use in metallurgical furnaces and to cooling plates as such manufactured in accordance with this method.

Cooling of metallurgical furnaces is normally effected by means of cast-iron cooling plates which incorporate cast-in steel pipes for a coolant to circulate therein. Such cooling plates may be manufactured to have both straight and coiled pipes arranged in one or two rows through the thickness of the plate.

There is known a method of manufacturing cooling plates, e.g. for use in blast furnaces, according to which the steel pipes for cooling are installed in a mold and cast with molten iron (see, for example, S. M. Andonev et al., Okhlazhdenie domennykh pechei, Metallurgizdat, Moscow 1972).

The prior-art method is disadvantageous because of considerable casting stresses taking place in the body of the plate and in the cooling pipes in the course of their cooling. The casting stresses in the cooling plates are brought about with the decline in temperature because of the difference in the linear expansion coefficients of cast iron and steel, the greatest concentration of stresses occurring at the places of bending of the pipes at their exit from the body of the cooling plate. When these stresses exceed permissible level, then even local carburization of the pipes at their bendings may sharply reduce plasticity of the pipe metal with cracks tending to form therein.

When coolers are used in blast furnaces, additional thermal stresses are due to appear in the cooling plate and pipes because of abrupt alterations in thermal conditions. These additional thermal stresses are added to the stresses occurring in the course of manufacturing cooling plates, thus causing untimely damage of the latter.

There is also known a method of manufacturing cooling plates for use in metallurgical furnaces, according to which separate portions of a plate, comprising cooling pipes made from a metal with the linear expansion coefficient different from that of the plate metal, are formed (see, for example, USSR Inventor's Certificate No. 287,252; Int. cl. B22 d 19/02, published on Feb. 19, 1970).

This method is carried out by pouring the metal of the plate into a foundry mold in two stages. During the first stage, a plate is cast to have T-shaped slots, open on the rear side of the plate, formed therein. Then, as cooling pipes are fitted into these slots, the second stage of casting is performed during which molten metal, for instance, an aluminium alloy with a melting temperature of 600° to 800° C. and a conductivity higher than that of cast iron, is poured into the slots.

When the above method is carried out with the use of aluminium alloy, the carburization of the pipes presents no problem, but the protruded sections of the pipes undergo the same stresses as those occurring during simultaneous casting of metal into the mold provided with cooling pipes.

In addition, the use of different metals for making a cooling plate, especially when arranged in close proximity to the cooling pipes, may result in a gap between the plate portions made from different metals. This gap inhibits effective removal of heat from the furnace wall.

In general, cooling plates for metallurgical furnaces comprise a metal plate per se and cooling pipes cast therein (see, for example, a book by V. A. Sorokin, entitled "Equipment for and Operation of Blast Furnaces", Metallurgizdat Publishers, Moscow, 1944, pp.76–79).

The above-mentioned plates are disadvantageous in that they are too bulky, with temperature conditions at different sections of the plate and its support extensions being unsatisfactory to permit their effective operation. Because of considerable thermal stresses and cracks developed therein the service life of cooling plates is greatly reduced.

In addition, such plates, especially those provided with support extensions, are ineffective in use because of a great number of coolant inlet and outlet openings, to say nothing of the difficulty encountered in detecting and disconnecting the burnt-out pipes in the support extensions. Among other deficiencies is a possible penetration of moisture into the melting chamber of the furnace with the resultant impairment of operating conditions.

SUMMARY OF THE INVENTION

It is an object of the present invention to provide a method of manufacturing cooling plates for use in metallurgical furnaces whereby it will be possible to preclude the occurrence of casting stresses in pipes and carburization of pipes as well as to eliminate the adverse effect of thermal stresses. Another object is the provision of a novel cooling plate with higher thermal resistance and heat-exchange capacity.

Thus, the invention provides a method of manufacturing cooling plates for use in metallurgical furnaces, which comprises separate casting of portions of a plate having cooling pipes made from a metal with the linear expansion coefficient thereof being different from that of the plate metal, wherein, according to the invention, prior to pouring metal into a mold, partitions are set therein to form mold cavities required to produce an intermediate portion of the plate and the plate portions with protruded cooling pipes, whereupon molten metal is poured into the mold cavity for producing an intermediate portion of the plate, and as the obtained casting is cooled down substantially to the ambient temperature, the metal is poured into the mold cavities for producing the portions with protruded cooling pipes, with expansion gaskets being arranged at the boundary of said mold cavities before metal is poured into the mold cavities intended for the production of the portions with protruded cooling pipes.

With the method of the invention it becomes possible:

to preclude the occurrence of stresses in the pipes, particularly at the places of their bending;

to prevent carburization of the pipes at the places of their exit from the plate, in view of a small amount of molten iron used for casting the plate portions with protruded cooling pipes, and in view of a short time required for the solidification of the cast-in iron (the time of contact between the pipes and the molten iron is reduced);

to preclude the influence of thermal stresses occurring in a cooling plate during operation.

This makes it possible to enhance thermal resistance of the cooling plates and to prolong overhaul life of the blast furnace used.

Prior to pouring molten metal into the mold cavity for producing the intermediate portion of the plate, the mold cavity in question is preferably divided into at least two mold cavities by means of partitions with expansion gaskets.

It is preferable that at least one of the mold cavities for producing an intermediate portion of the plate be poured in with molten metal having chemical-and-physical properties thereof different from those of the metal poured into adjacent mold cavities. This is advisable when the intermediate portion with a support extension is to be made of metal having higher-than-usual strength properties.

There is also provided a cooling plate for metallurgical furnaces, which comprises a metal plate per se with a cast-in cooling pipe, wherein, according to the invention, the metal plate per se includes three portions with expansion gaskets being set at their boundaries which are found between and adjacent the protruded sections of the cooling pipes, thereby forming an intermediate portion of the plates.

Such cooling plate construction permits each portion of the plate to function independently under sharply altering thermal loads. In this case, thermal loads in the plate will relax at the joints between the plate forming portions, that is, in the plane of the partitions.

The intermediate portion of the plate is preferably divided into at least two portions with an expansion gasket set at the boundary between these portions.

Essentially, the cooling plate is constructed in such a manner that a part of one of the portions of the intermediate section of the plate extends beyond the face of the cooling plate and into the melting chamber of the furnace, the part of the intermediate section extending beyond the face of the cooling plate having at least one individual cooling pipe cast in its body.

The cooling plate is preferably made in such a way that at least one cooling pipe in the portion with a part thereof extending beyond the face of the cooling plate is enclosed in this portion to provide a closed circuit with the section thereof under cooling being arranged in the zone of action of the cooling pipe.

Preferably, the cooling plate is made so that the section with a protruded part have two closed cooling pipes arranged in diagonal planes of the plate face.

Such cooling plate construction permits reliable cooling of the support extensions and thus prevents the formation of cracks in the body of the latter. Owing to this fact, as well as to higher thermal resistance of all the plate portions, it has become possible to prolong service life of the cooling plate and increases the overhaul period of the blast furnace.

This cooling plate construction is also advantageous in that it facilitates detecting and disconnecting the burnt-out pipes in the support extension, since they have no communication with an outside water supply source. It also becomes possible to prevent the uncontrolled penetration of water into the melting chamber of the furnace in case of burning-out of pipes in the support extension.

DETAILED DESCRIPTION OF THE PREFERRED EMBODIMENTS

According to the invention, a method of manufacturing cooling plates for use in metallurgical furnaces is performed by way of casting separate portions of the plate with a molten metal, such as iron.

To this end, cooling pipes are first mounted in the mold cavity. Then, partitions with expansion gaskets made, for example, from asbestos are set into the mold cavity. As a result, molding cavities are respectively formed for casting an intermediate portion of the plate and a portion with protruded sections of the cooling pipes. In addition, each molding cavity for casting the intermediate portion can be divided by partitions with asbestos expansion gaskets.

There can be provided at least two of such additional molding cavities.

The foundry mold thus prepared is then cast with molten iron having a temperature of 1180° to 1220° C. The molding cavity intended to produce the intermediate portion of the plate is first to be cast in. This cavity is obtained as the adjacent portions of the mold cavity are packed with a molding sand. After the molten iron poured into the mold cavity is cooled down to a temperature of not higher than 200° C., it is removed from the mold, the molding sand is taken away from the adjacent portions of the molding cavity, whereupon these cavities are cast with molten iron. Prior to pouring molten iron into the adjacent mold cavities (into those used for the production of the cooling plate portions with protruded cooling pipes), expansion gaskets are set at the boundary of the mold cavities. If the intermediate portion molding cavity is divided into at least two cavities, then at least one of them is cast with a metal having physical and chemical properties thereof different from those of the metal cast into the adjacent molding cavities.

The method of the invention permits cooling plates to be produced substantially as illustrated in the accompanying drawings.

Figure 3:
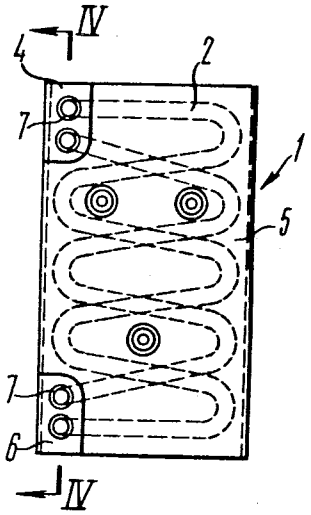
FIG. 3 is a rear view of another embodiment of the invention.
Figure 4:
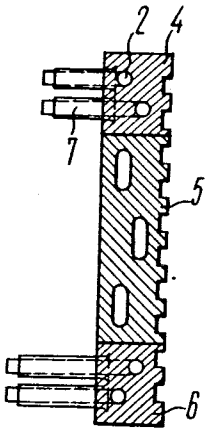
FIG. 4 is a cross-section on line 4—4 of FIG. 3.
Figure 1:
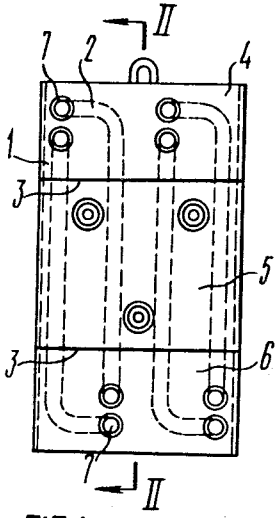
FIG. 1 is a rear view of a cooling plate according to the invention.
Figure 2:
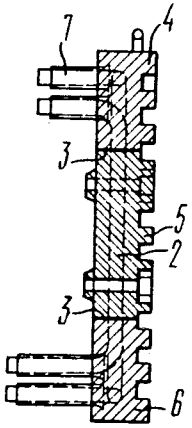
FIG. 2 is a cross-section on line 2—2 of FIG. 1.

Reference is now made to FIGS. 1–4 showing a cooling plate comprising a metal plate 1 proper with a cast-in cooling pipe 2. The metal plate 1 is divided by asbestos expansion gaskets 3, for instance, into three portions 4, 5 and 6. The gaskets 3 are arranged between protruded sections 7 of the cooling pipes 2 and adjacent thereto, thereby forming an intermediate portion 5 of the plate. The cooling pipe 2, cast-in the cooling plate, may be either straight (FIGS. 1 and 2) or coiled (FIGS. 3 and 4). FIGS. 1 and 2 show a cooling plate with the cast-in straight cooling pipes 2. As mentioned before, the expansion gaskets 3 are arranged between and adjacent the protruded sections 7 of the cooling pipes 2 in a manner dividing the cooling plate, for instance, into three rectangular portions 4, 5 and 6. However, in accordance with the shape of the cooling pipes, in this particular case the gaskets are bent at an angle so as to reduce the casting stresses near the protruded sections of the cooling pipes.

Figure 5:
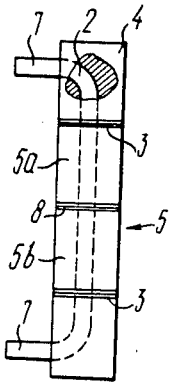
FIG. 5 is a side view of an alternative embodiment of the cooling plate according to the invention.

FIG. 5 shows the cooling plate with the intermediate portion 5 thereof divided into two portions, namely: a first portion 5*a* and a second portion 5*b*. Arranged at the boundary between these two portions is an expansion gasket 8.

Figure 6:
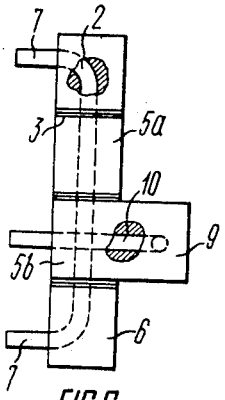
FIG. 6 is a side view of the cooling plate with a support extension.

FIG. 6 shows a cooling plate made substantially as shown in FIG. 5 and provided with a support extension 9. However, a part of the second portion 5*b* extends beyond the face side of the cooling plate and into the melting chamber of the furnace to serve as the support extension 9, the portion 5*b* having an individual pipe 10 cast into its body.

Figure 7:
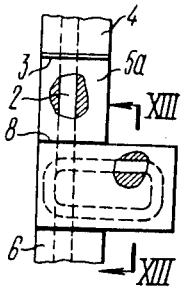
FIG. 7 is a side view of the cooling plate according to the invention with a modified support extension.
Figure 8:
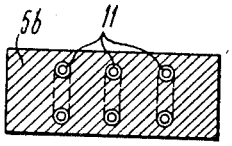
FIG. 8 is a cross-section of line 8—8 of FIG. 7.

FIGS. 7 and 8 show a cooling plate made substantially as shown in FIG. 6 and provided with a support extension 9. However, the cooling pipe cast in the portion 5*b* and shown at 11 is made closed within this portion to provide a closed circuit for a cooling medium. The circuit portion under cooling is in the zone of action of the cooling pipe 2 of the plate.

Figure 9:
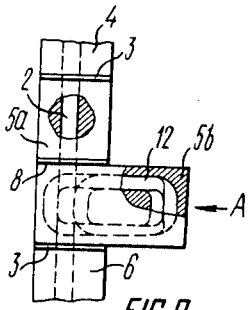
FIG. 9 is a side view of the cooling plate portion with a modified support extension.
Figure 10:
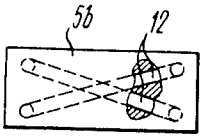
FIG. 10 is a view along arrow A in FIG. 9.

FIGS. 9 and 10 show a cooling plate with a support extension 9, made substantially as shown in FIG. 6. However, the portion 5*b* with the support extension 9 includes two closed pipes 12 arranged in diagonal planes extending through the diagonals of the face side of the portion 5*b* provided with the support extension 9.

The method of the present invention makes it possible to manufacture cooling plates of a new construction ensuring higher operation characteristics of these plates, namely:

each portion of the cooling plate is permitted to function independently under sharply changing thermal loads: thermal stresses in the plate will relax at the joints between all the portions forming the plate, that is in the plane of the partitions;

a reliable cooling of the support extensions is provided to prevent the formation of cracks in the body of the latter and thus ruling out its untimely damage. This, as well as higher thermal resistance of all the plate portions prolongs service life of the cooling plate and consequently, the averhaul of the blast furnace.

It is to be noted that the cooling plate construction, such as shown in FIG. 7, facilitates detecting and disconnecting the burnt-out pipes in the support extension, since they have no connection with an outside water supply source, and prevents uncontrolled penetration of water into the melting chamber of the furnace in case of burning-out of pipes in the support extension.

We claim:

1. A method of manufacturing a cooling plate for a furnace, comprising the steps of disposing at least one cooling pipe and a plurality of partitions in a mold, to divide the mold into three sections, an intermediate section and two outer sections, pouring molten metal into the intermediate section, allowing the molten metal to cool down to substantially ambient temperature, after the molten metal has cooled to the substantially ambient temperature, pouring metal into at least one of the outer sections, and prior to pouring molten metal into the one of the outer sections, disposing an expansion gasket adjacent the respective partition thereof.

2. The method of claim 1, wherein the expansion gaskets are disposed on the partitions prior to disposition of the latter in the mold.

3. The method of claim 1, wherein the molten metal is simultaneously poured into both the outer sections.

4. The method of claim 1, wherein the molten metal is first poured into one of the outer sections, and then into the other of the outer sections.

5. The method of claim 1, additionally comprising disposing an expansion gasket within the intermediate section prior to pouring molten metal therein, to divide the intermediate section into a plurality of portions.

6. The method of claim 5, which comprises pouring, into one of the portions of the intermediate section, molten metal having different chemical and physical properties from molten metal poured into the adjacent portion and section.

* * * * *